United States Patent [19]

Lautin

[11] 3,963,104

[45] June 15, 1976

[54] HANDLE AND MEANS FOR SECURING SAME TO A PIECE OF LUGGAGE

[76] Inventor: Leon Lautin, 43 White Drive North, Cedarhurst, N.Y. 11516

[22] Filed: Apr. 7, 1975

[21] Appl. No.: 565,800

Related U.S. Application Data

[63] Continuation of Ser. No. 465,601, April 30, 1974, abandoned, which is a continuation of Ser. No. 233,900, March 13, 1972, abandoned.

[52] U.S. Cl. ..... 190/58 R; 224/45 P; 16/126

[51] Int. Cl.[2] ..... A45C 13/22

[58] Field of Search ..... 190/58 R, 57, 56; 16/111 R, 126; 224/45 P

[56] References Cited

UNITED STATES PATENTS

| | | | |
|---|---|---|---|
| 1,209,791 | 12/1916 | Wootten | 16/126 |
| 1,223,503 | 4/1917 | Markowitz | 190/58 |
| 1,721,960 | 7/1929 | Krischer | 190/56 |
| 3,185,272 | 5/1965 | Chance | 190/57 |

*Primary Examiner*—Robert J. Spar
*Assistant Examiner*—Kenneth Noland
*Attorney, Agent, or Firm*—Bauer, Amer & King

[57] ABSTRACT

Improved, low cost means are provided for securing a handle to the wall of a piece of luggage. The handle is provided with a bar that connects the free ends of the side posts which are secured to the hand gripping portion of the handle. A U-shaped strap is positioned over the connecting bar and is provided with a plurality of means arranged to pass through the wall of the piece of luggage and be bent over the inside surface thereof. In one embodiment of the invention, the strap is provided with tabs that fit between adjacent support sections of the bar in order to limit any relative axial movement between the strap and the bar. In another embodiment of the invention, the tabs are bent around the bar prior to assembling the strap to the wall of the luggage.

1 Claim, 7 Drawing Figures

FIG. 1
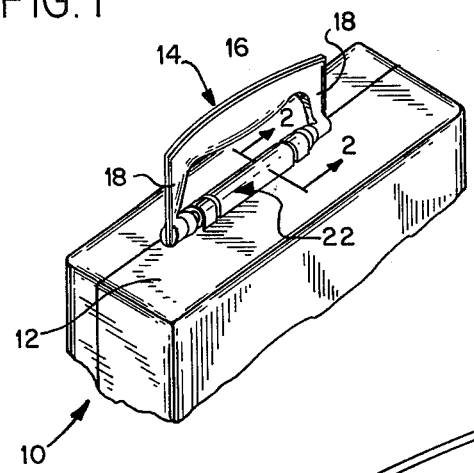
FIG. 2
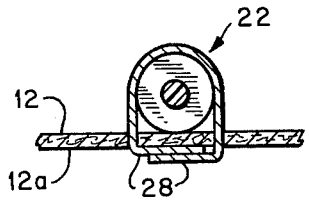
FIG. 3
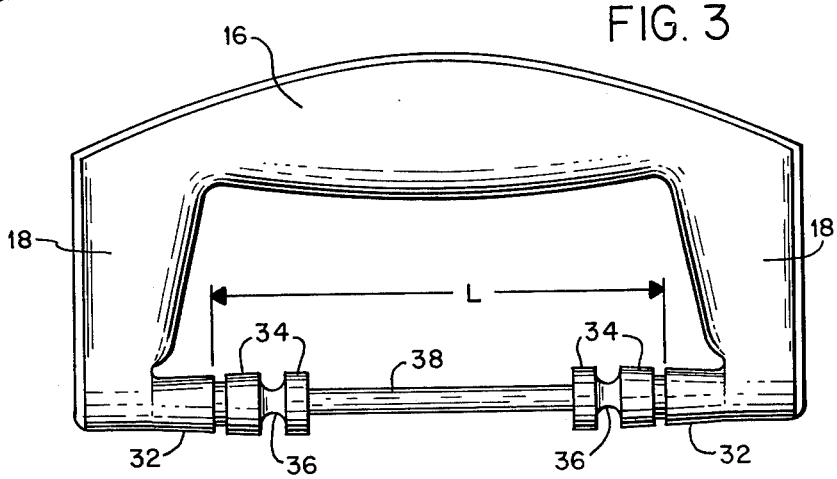
FIG. 4
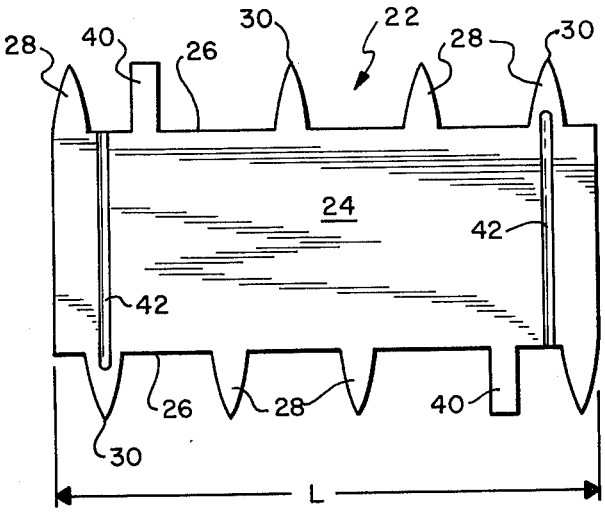
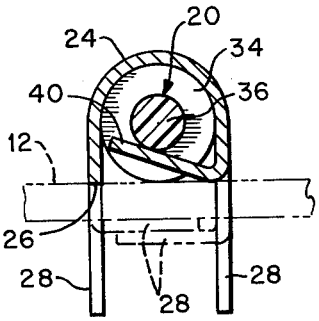
FIG. 6
FIG. 7
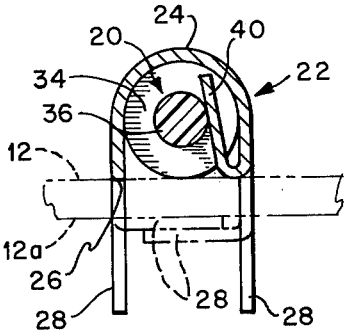
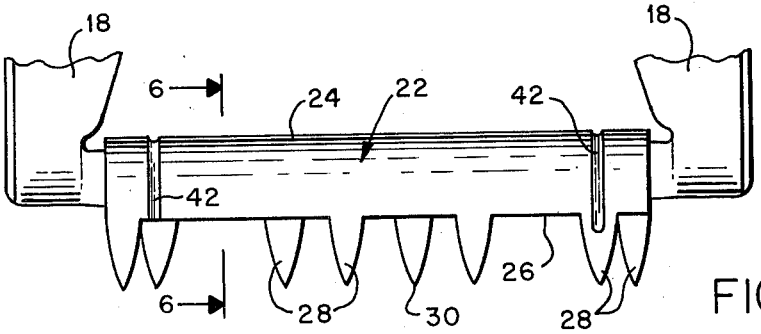
FIG. 5

HANDLE AND MEANS FOR SECURING SAME TO A PIECE OF LUGGAGE

This application is a continuation of application Ser. No. 465,601 filed Apr. 30, 1974 now abandoned, which is a continuation of application Ser. No. 233,900 filed Mar. 13, 1972, now abandoned.

The aforementioned abstract is neither intended to define the invention of the application which, of course, is measured by the claims, nor is it intended to be limiting as to the scope of the invention in any way.

BACKGROUND OF THE INVENTION

Field of the Invention

This invention relates generally to the luggage art and, more particularly, to an improved handle therefor, together with means for securing the handle to a piece of luggage.

SUMMARY OF THE INVENTION

In order to simplify the construction and lower the cost of manufacturing a piece of luggage, the present invention provides an improved handle means for securing the handle to the luggage. In its broadest aspect, the handle is provided with a bar that connects the side posts thereof. A metallic strap is formed to fit over the bar intermediate the side posts. It is within the scope of this invention to provide one or more tabs integral with the strap and positioned to abut spacedly transverse faces of support sections formed on the bar to thereby limit axial displacement of the strap relative to the bar. In one embodiment of the invention, the strap is provided with a pair of tabs, each of which sit between closely adjacent axially spaced support sections of the bar and thereby limit axial displacement of the strap relative to the bar.

In an alternative embodiment of the invention, the tabs are bent around the bar prior to the strap being secured to the wall of the luggage case. In both of the embodiments of this invention, the strap is provided with a plurality of members which are adapted to pass through the wall of the luggage and be bent against the inside surface thereof. In one form of the invention, the members that extend through the wall of the luggage are relatively sharp and are adapted to actually pierce the luggage. Alternatively, preplaced holes may be formed in the wall of the luggage to receive the members that pass therethrough.

Accordingly, it is an object of the present invention to provide an improved handle for a piece of luggage.

Another object of the present invention is to provide an improved luggage handle and simplified, low cost means for securing the handle to a piece of luggage.

A further object of the present invention is to provide an improved handle that may be secured to a piece of luggage by means of a strap that extends around a portion of the handle and also through a wall of the luggage.

An additional object of the present invention, as described above, is to provide means for keying the strap to a portion of the luggage handle to thereby limit axial movement of the strap relative to the handle.

These and other objects, features and advantages of the invention will, in part, be pointed out with particularity and will, in part, become obvious from the following more detailed description of the invention, taken in conjunction with the accompanying drawing, which forms an integral part thereof.

BRIEF DESCRIPTION OF THE DRAWING

In the various figures of the drawing, like reference characters designate like parts.

FIG. 1 is a fragmentary, perspective view of a piece of luggage incorporating the handle comprising the present invention;

FIG. 2 is a fragmentary, sectional, elevational view taken along line 2—2 of FIG. 1;

FIG. 3 is an elevational view of the handle portion of the present invention;

FIG. 4 is a developed plan view of the blank comprising the means for securing the handle to the wall of the luggage;

FIG. 5 is a fragmentary, elevational view illustrating the handle and the means for securing the handle to the luggage in the assembled condition;

FIG. 6 is a transverse, cross sectional view taken along line 6—6 of FIG. 5; and FIG. 7 is a transverse, cross sectional view similar to FIG. 6 illustrating an alternative embodiment to the present invention.

DESCRIPTION OF THE PREFERRED EMBODIMENT

Referring now to the drawing, there is shown fragmentarily in FIG. 1 a piece of luggage 10 having secured to a wall 12 thereof a handle 14 comprising the present invention. The handle 14, as shown best in FIG. 3, includes a central hand gripping section 16 and a pair of side posts 18 extending downwardly from the ends of the hand gripping portion 16. The ends of the side posts 18 remote from the hand gripping portion 16 have formed integrally therewith a connecting bar generally designated by the reference character 20.

Referring once again to FIG. 1 as well as to FIG. 2, it will be seen that there is also provided a metallic strap generally designated by the reference character 22 which fits about the bar 20 and which serves to secure the handle 14 to the wall 12 of the luggage 10. As may best be seen in the developed plan view of FIG. 4, the strap 22 has a central body portion 24 that terminates in longitudinally extending substantially parallel, spaced apart side edges 26. A plurality of axially spaced apart fingers 28 extend outwardly from the side edges 26 and, in the embodiment illustrated, terminate in relatively sharp points 30. When the strap 24 is formed, such as by bending in a die, the central portion thereof is arcuate, as shown in FIG. 2 for example, and the fingers 28 extend downwardly therefrom so as to pass through the wall 12 of the luggage 10 and be bent under the inside surface 12*a* of the luggage. In the embodiment illustrated, the points 30 of the members 28 are sharp enough to pierce the wall 12. Alternatively, preplaced holes may be formed in the wall 12 so as to receive the members 28 prior to their being bent over as shown in FIG. 2.

As shown in FIG. 3, the bar 20 is provided with enlarged outboard support sections 32 adjacent each of which are a pair of axially spaced apart, somewhat smaller support sections 34. Intermediate the support sections 34 there is provided an annular undercut 36. The two inboard support sections 34 are connected to each other by a central member 38. It should be noted at this time that the dimension L between the oppositely facing transverse faces of the support sections 32 is substantially the same as the dimension L shown in FIG. 4. Thus, when the strap 24 is applied to the bar 20, all of the support sections 32 and 34 would be substantially concealed as will be the undercuts 36 and the connecting member 38.

The strap 22 is further provided with a tab 40 extending outwardly from each of the side edges 26. The strap 22 is also provided with a transversely extending rib 42 proximate each end thereof. Thus, in the assembled condition, the ribs 42 will abut the transverse interface between adjacent sections 32 and 34 of the connecting member 20.

In one embodiment of the invention, as shown in FIG. 6, a tab 40 is positioned in the annular undercut 36 intermediate each of the two smaller support sections 34 and is bent so as to lie intermediate the connecting member 20 and the outside surface of the wall 12. The fingers 28, after they are passed through the wall 12, either by piercing the wall or by utilizing preplaced holes, are bent underneath the inner surface 12*a* of the wall 12 as shown in phantom outline in FIG. 6.

In an alternative embodiment of the present invention, as shown in FIG. 7, the tabs 40 are positioned in the annular undercuts 36 between adjacent support sections 34 but do not lie intermediate the cross member 20 and the outer surface of the wall 12. As in the previous embodiment, the fingers 28 are bent against the inside surface 12*a* of the wall after the members 28 pass therethrough. Thus, in the second embodiment, the preassembly of the strap 22 to the handle 14 is eliminated and yet the strap 22 is effectively keyed to the handle 14 by means of the tabs 40 being positioned in the annular undercuts 36. The second embodiment of the invention disclosed herein provides for a somewhat less expensive construction since the preassembly of the strap 22 to the handle 14 has been eliminated.

From the foregoing, it should be readily appreciated that a relatively inexpensive and simple construction has been provided for a novel handle as well as means for securing the handle to a piece of luggage. The handle may be molded at a very low cost from a suitable plastic material and the strap that secures the handle to the luggage may be stamped from any suitable metal and may be appropriately plated or otherwise made esthetically appealing. A very simple and low cost assembly procedure is required. The strap, when provided with sharpened fingers depending from the body thereof, may be used to pierce the wall of the luggage to which the handle is to be secured or preplaced holes may be provided in the wall of the luggage. The strap may very easily be keyed to the luggage to prevent axial displacement relative to the handle by means of tabs that are positioned in annular undercuts formed in the connecting member of the handle.

Although the invention has been described in connection with luggage, it is to be understood that the term luggage is employed in its broadest sense and is intended to encompass any article having means for affixing thereto the handle of this invention for carrying purposes.

There has been disclosed heretofore the best embodiment of the invention presently contemplated. However, it is to be understood that various changes and modifications may be made thereto without departing from the spirit of the invention.

What I claim as new and desire to secure by Letters Patent is:

1. An assembly for securing a molded plastic handle including an elongated gripping portion and a side post extending downwardly from each end thereof to a wall of a piece of luggage, said assembly comprising:

a. a rigid bar extending between the ends of the side posts that are remote from the gripping portion of the handle, said bar being spaced from and substantially parallel to the handle gripping portion, said bar including two axially spaced apart undercuts encircling said bar and two axially spaced apart transverse interfaces intermediate the said posts and outwardly spaced from said undercuts along said posts;

b. an elongated metallic strap mounted on said bar, said strap having two integral, deformable tabs spaced inwardly from the ends thereof for engaging said undercuts on said bar and two internally directed ribs spaced inwardly from the ends of said strap and positioned so as to engage said transverse interfaces on said bar to thereby limit axial movement of said strap relative to said bar, said strap including a pair of longitudinally extending, spacedly parallel side edges having a length dimension greater than the axial spacing between said interfaces for concealing said undercuts and said transverse interfaces; and c. a plurality of deformable finger means integral with and spaced along each said side edge of said strap for securing said strap to the luggage wall, said finger means being alternately positioned on said side edges of said strap, said finger means having pointed ends that are adapted to pierce the luggage wall and to be bent towards each other and against the inside surface thereof, said finger means being sufficiently long so that they overlap each other and extend past the longitudinal axis of said bar after they are bent.

* * * * *